United States Patent [19]

Lense

[11] Patent Number: 4,553,656

[45] Date of Patent: Nov. 19, 1985

[54] POWER ACTUATED OPERATOR FOR WINDOWS AND THE LIKE

[75] Inventor: Robert F. Lense, Rockford, Ill.

[73] Assignee: Amerock Corporation, Rockford, Ill.

[21] Appl. No.: 545,780

[22] Filed: Oct. 27, 1983

[51] Int. Cl.[4] ..... E05F 15/10

[52] U.S. Cl. ..... 192/142 R; 49/139; 49/140; 192/150

[58] Field of Search ..... 192/142 R, 150; 74/625; 49/139, 140

[56] References Cited

U.S. PATENT DOCUMENTS

| | | | |
|---|---|---|---|
| 2,311,972 | 2/1943 | Simpson | 192/142 R |
| 2,621,543 | 12/1952 | Rossmann | 49/140 |
| 2,926,905 | 3/1960 | Ahlgren | 74/89.13 |
| 4,293,060 | 10/1981 | Miller | 192/150 |
| 4,429,591 | 2/1984 | Zuch et al. | 74/625 |
| 4,481,735 | 11/1984 | Jentoft et al. | 49/139 |

*Primary Examiner*—William A. Cuchlinski, Jr.
*Attorney, Agent, or Firm*—Leydig, Voit & Mayer Ltd.

[57] ABSTRACT

A power actuator for a window includes a rotary drive member and a rotary driven member which is turned by the drive member and which is connected to the sash of a window to open and close the sash as the drive member is turned in one direction or the other. A reversible electric motor drives a speed reducing gear train and the output gear of the train is coaxial with and rotatable relative to the drive member, a crank arm with a projecting pin is pivotally mounted on the drive member to swing between an active or radially projecting position and an inactive position overlying the drive member. When the arm is in the inactive position, the pin connects the output gear and the drive member so that the motor may turn the driven member. With the arm in the active position, the pin no longer couples the output gear and the drive member and the latter may be turned manually by the crank arm independently of the gear train. When the sash reaches either the fully open or fully closed position by power actuation, the motor stalls and the stall current is sensed to stop the motor and reverse the latter momentarily to relieve the torque in the gear train.

18 Claims, 11 Drawing Figures

POWER ACTUATED OPERATOR FOR WINDOWS AND THE LIKE

BACKGROUND OF THE INVENTION

This invention relates to an operator for opening and closing a closure such as a window and, more particularly, to an operator for moving the window sash between open and closed positions such as by swinging the sash of an awning window. Customarily, such operators include a driven member operatively connected to the sash and a rotary drive member connected to the driven member. A crank arm projects radially outwardly from the drive member and is used to manually turn the drive member so as to move the sash.

SUMMARY OF THE INVENTION

The general object of the invention is to provide a novel actuator which incorporates a motor and a transmission connecting the motor with the drive member so that the closure may be moved by power while permitting the drive member to be disconnected from the transmission so that the closure may easily be operated manually.

A more detailed object is to employ a crank arm which is mounted on the drive member to move between active and inactive positions and to arrange the parts so that the transmission is uncoupled from the drive member when the crank arm is in the active position for manual operation while the transmission and the drive member are coupled automatically as an incident to the crank arm being moved to the inactive position.

Another object is to employ a gear train as the transmission between the motor and the drive member with the output gear of the train coaxial with and rotatable relative to the drive member and to provide a projection on the crank arm with the projection being in driving engagement with the output gear when the crank arm is in the inactive position.

Still another object is to provide, in a power actuator of the foregoing type, a novel means for sensing when the closure has reached the closed position or a predetermined open position and to deenergize the motor when such a position is sensed.

The invention also resides in the details of the novel construction and cooperation of the motor, the gear train, the drive member and the crank arm.

DETAILED DESCRIPTION OF THE PREFERRED EMBODIMENT

Figure 1:
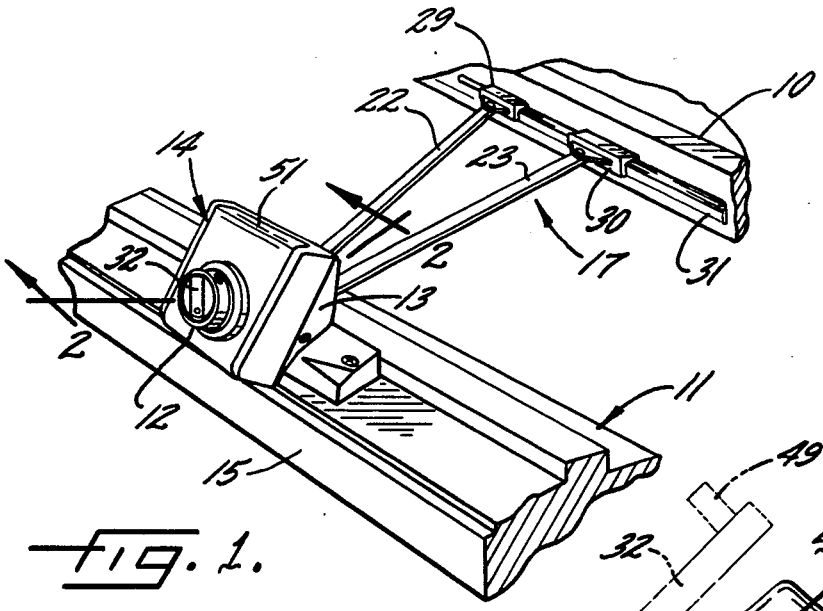
FIG. 1 is a fragmentary perspective view of an awning window utilizing the power actuated operator embodying the present invention.

As shown in the drawings for purposes of illustration, the invention is embodied in an operator for opening and closing a closure such as the sash 10 of an awning window in which the sash swings in a frame 11 about a horizontal axis extending along the upper edge of the sash. The operator includes a manually actuatable drive member 12 which is journaled in the body 13 of a housing 14 secured to the sill 15 of the window frame and is operatively connected to the lower edge of the sash through gearing 16 (FIG. 3) and a linkage 17. The former includes a bevel gear 18 keyed to the lower end of a shaft 19 which is journaled in the housing body coaxially with the drive member 12, the common axis a being inclined relative to the vertical by about 45 degrees. The shaft is driven by the drive member to turn with the latter. The gear 18 meshes with a second bevel gear 20 which is fast on the inner end of a horizontal shaft 21 journaled in the body 13 perpendicular to the opening in the window frame, the shaft 19 constituting the output of the actuator.

Figure 2:
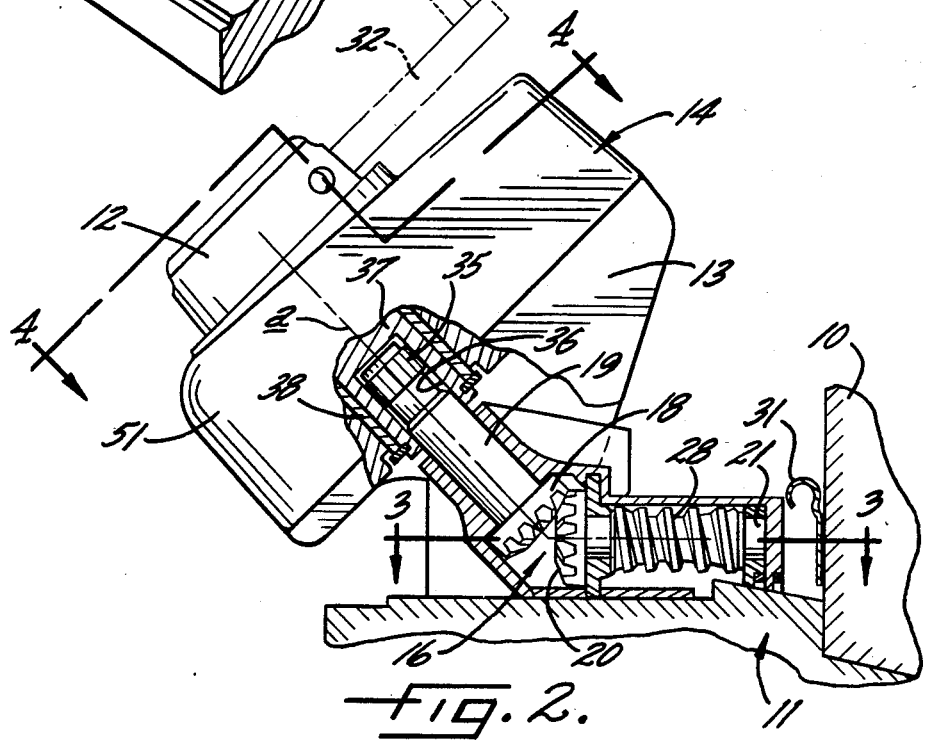
FIG. 2 is an enlarged fragmentary sectional view taken along the line 2—2 in FIG. 1.
Figure 3:
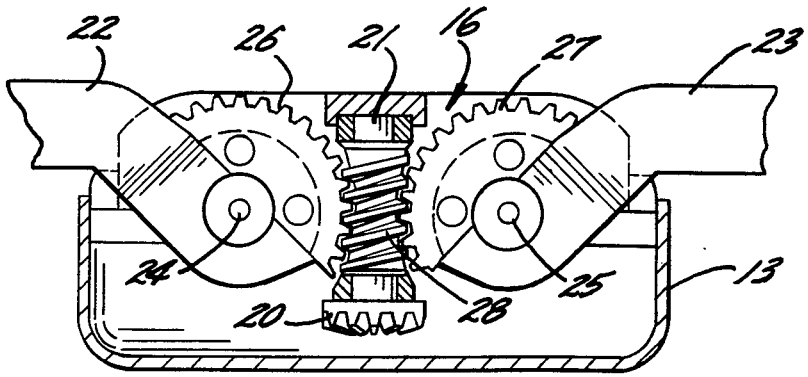
FIG. 3 is a fragmentary sectional view taken along the line 3—3 in FIG. 2.

The linkage 17 includes two arms 22 and 23 whose inner ends are disposed at opposite sides of the shaft 21 and are pivotally mounted on the housing body 13 as indicated at 24 and 25 in FIG. 3 to swing about vertical axes. Sector worm gears 26 and 27 fixed to the inner end portions of the arms mesh with a worm 28 formed on the shaft 21 so that the arms swing together and apart as the drive member 12 is turned back and forth about the axis a. Pivotally mounted on the free ends of the arms are shoes 29 and 30 which slide on a horizontal track 31 mounted alongside the lower edge of the sash 10. Thus, the sash swings outwardly when the arms are turned toward each other and, conversely, the sash swings in to the closed position illustrated in FIG. 2 when the arms are swung apart. A manually operable member 32 is connected to the drive member 12 to turn the latter and hence operate the window by hand.

The present invention contemplates a novel arrangement for the power actuation of the driven member 19, and thus of the closure 10, by a motor 33 (FIGS. 4 through 7) while still permitting selective and easy operation by hand. To this end, the motor turns the drive member 12 through a speed reducing transmission 34 which is uncoupled from the drive member when it is desired to operate the closure by hand. Preferably, the manual member 32 is arranged to have active and inactive positions so as to be in condition for manual operation when in the active position and in condition for power actuation in the inactive position and the drive member and the transmission are automatically coupled and uncoupled as an incident to the manual member being moved into and out of the active position.

In the form shown in the drawings, the upper end portion 35 of the shaft 19 is splined and received in an axial counterbore 36 formed in a cylindrical shaft extension or coupler 37 centered along the axis a coaxially with the shaft. The coupler is journaled in a cylindrical bearing 38 (FIG. 6) which is pressed into a mating sleeve 39 formed as an integral part of a web 40 extending across the interior of the housing body 13. A flange 41 on the upper end of the bearing abuts the end of the sleeve and the coupler is held in the bearing against outward movement by a snap ring 42 which is received in a peripheral groove 43 in the lower end portion of the coupler and which abuts the underside of the bearing.

Figure 9:
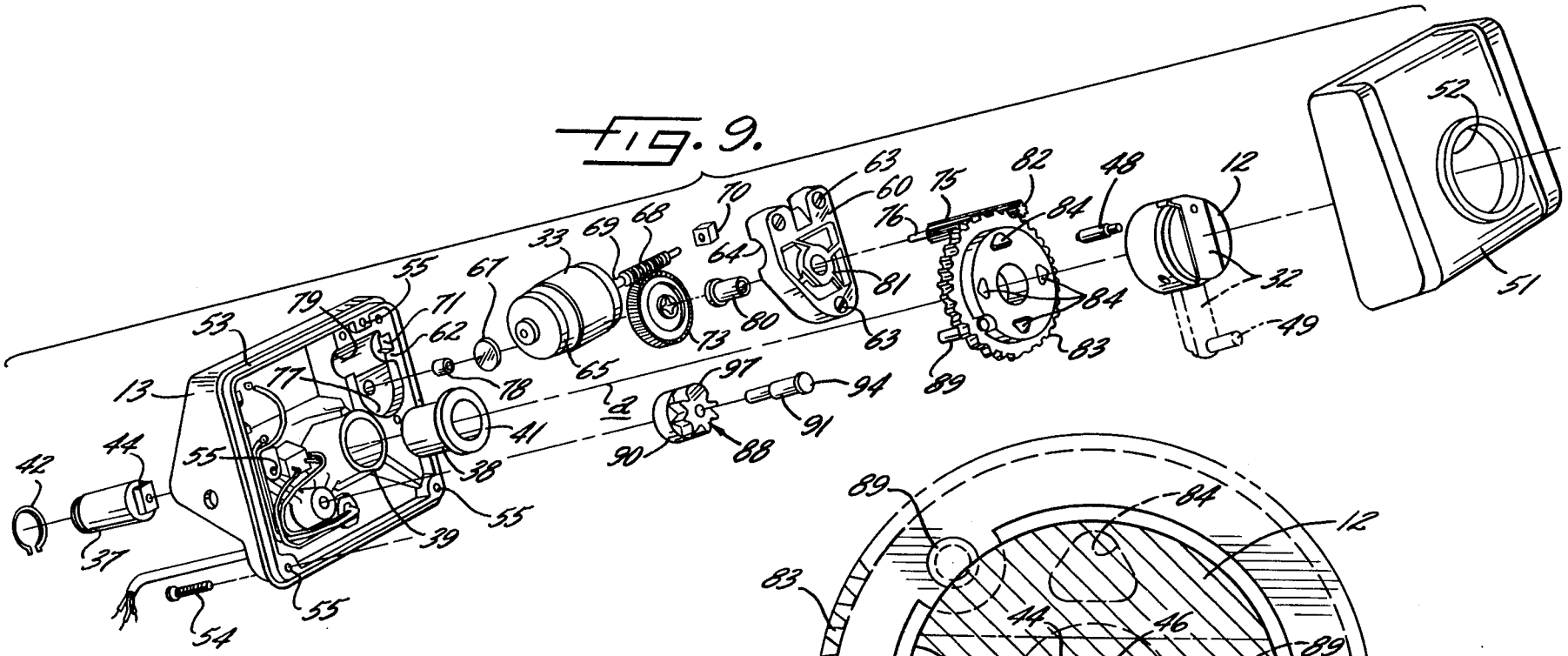
FIG. 9 is an exploded perspective view of the operator.

Herein, the drive member 12 is a cylindrical hub secured to the outer end of the coupler 37 and, for this purpose, a squared axial boss 44 (FIGS. 6 and 8) on the end of the coupler projects into a central recess 45 in the underside of the hub. The latter is fastened to the coupler by a screw 46 which projects axially through the hub and is threaded into the coupler. The manually operable member 32 is an elongated arm normally disposed in a slot 47 (FIG. 5) which extends diametrically across the top of the hub 12 and the arm is pivotally connected by a pin 48 at one end to the hub adjacent the periphery thereof to swing about a transverse axis. Thus, the arm may be swung from its inactive position in the slot 47 to an active position in which it projects radially out from the hub as illustrated in broken lines in FIGS. 2 and 6. In the active position, the arm serves as a crank for turning the hub 12 to open and close the sash 10 and, to facilitate this, a finger piece in the form of pin 49 is staked to the arm adjacent the free end thereof and projects perpendicularly from the arm. When the arm is in the inactive position, the pin projects into a peripheral slot 50 (FIG. 8) in the hub. A cover 51 for the housing 14 has an opening 52 through which the hub projects and the cover is snapped in place on a flange 53 projecting outwardly around the periphery of the housing body 13, the cover being secured in place by screws 54 (FIGS. 7 and 9) projecting through holes 55 in the body and threaded into the cover.

Figure 4:
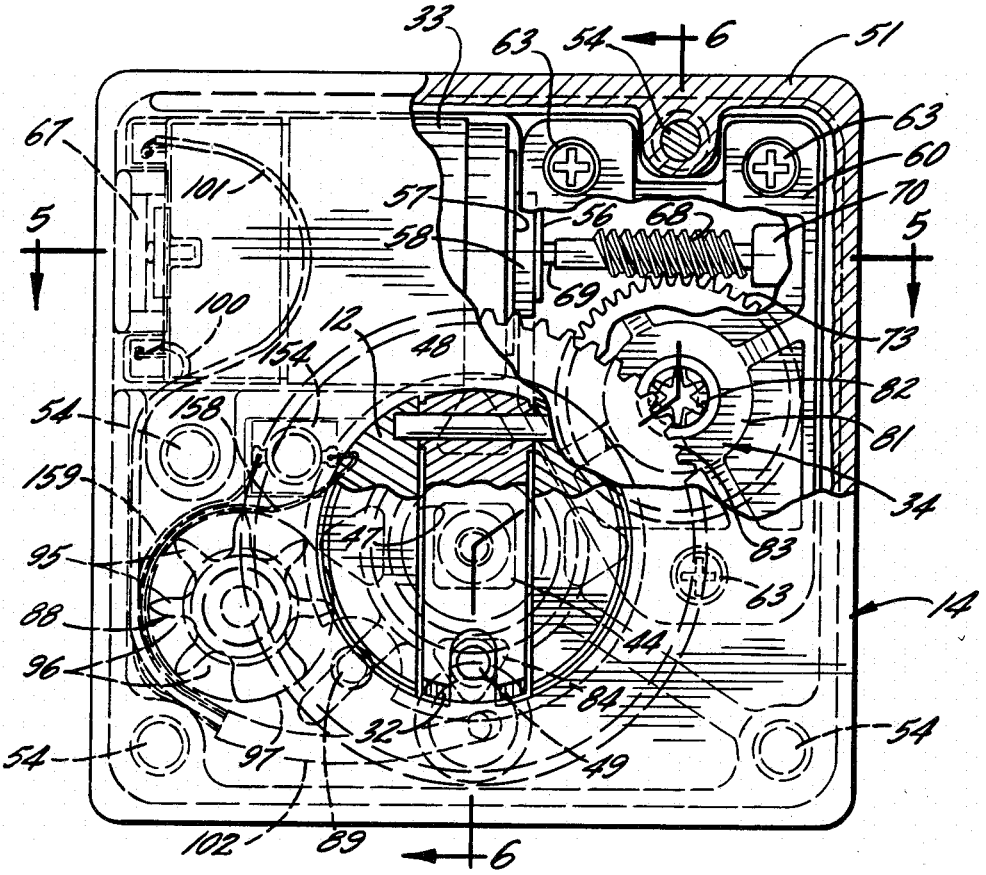
FIG. 4 is an enlarged sectional view taken along the line 4—4 in FIG. 2.
Figure 5:
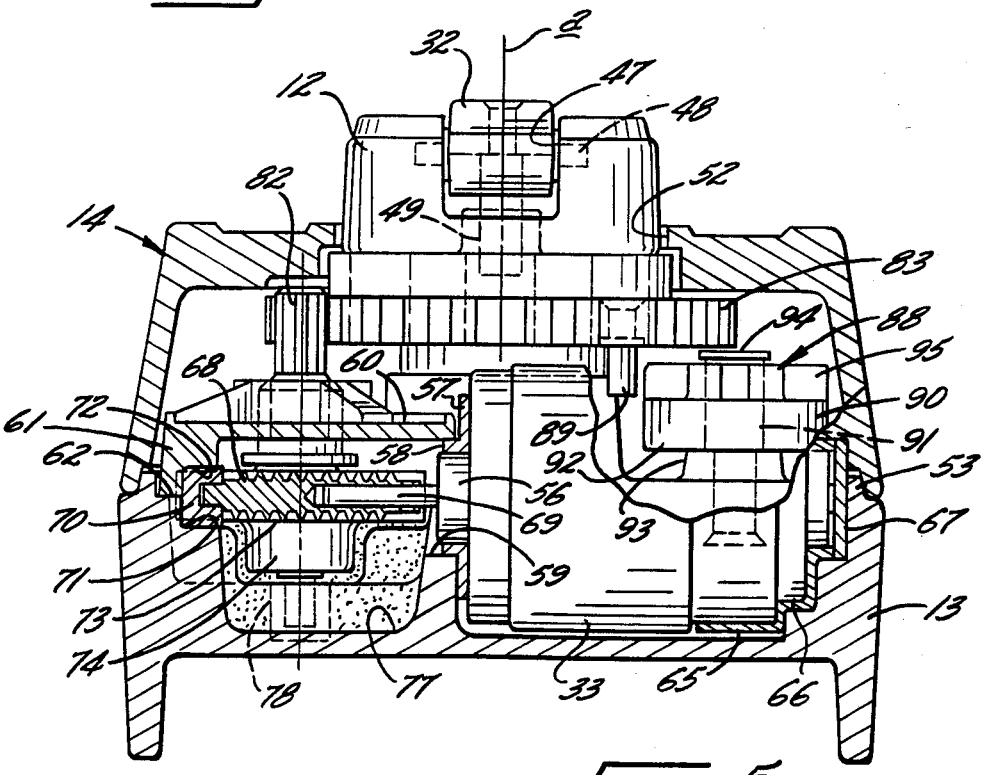
FIG. 5 is a sectional view taken along the line 5—5 in FIG. 4.
Figure 6:
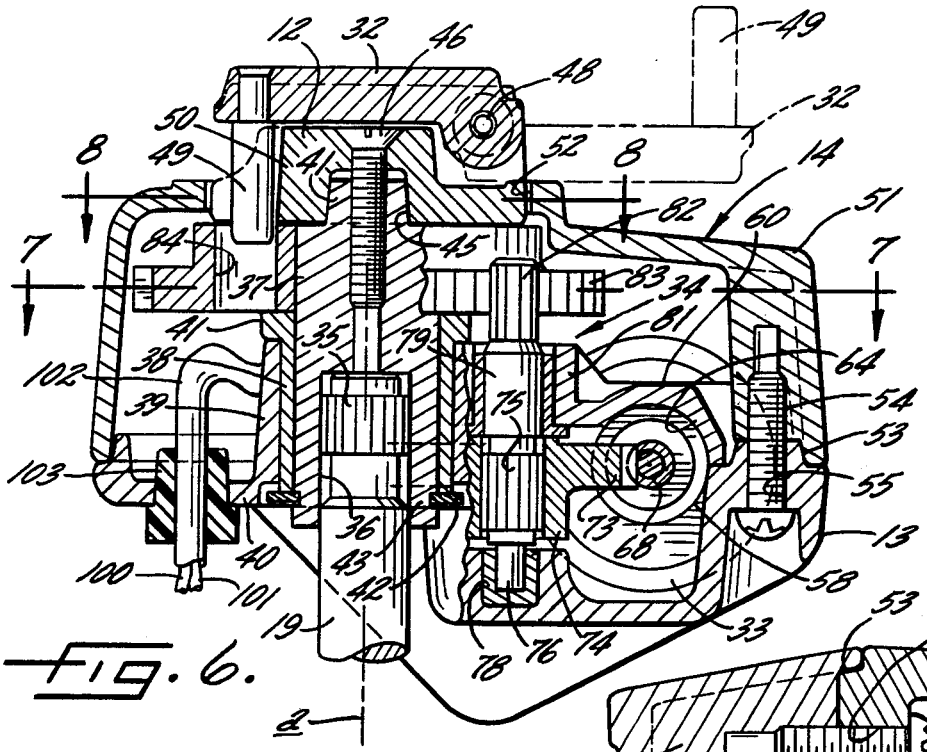
FIG. 6 is a sectional view taken along the line 6—6 in FIG. 4.

The motor 33 is a permanent magnet reversible direct current motor and is mounted in one corner of the housing body 13 as illustrated most clearly in FIGS. 4 and 5. For this purpose, the hub 56 of the motor at the output end thereof is received in a molded plastic annular mounting member 57 which has a circular flange 58 abutting an arcuate surface 59 on the interior of the housing body 13. A molded plastic partition 60 with a depending skirt 61 abuts against a shelf 62 in the housing body and is secured to the latter by screws 63 with an arcuate notch 64 (FIG. 6) in an edge of the skirt engaging the mounting member and holding the member in place against the surface 59. The other end of the motor is received in a cylindrical cup 65 (FIG. 5) which is made of molded plastic and which fits into a stepped recess 66 in a side wall of the housing body. A thrust washer 67 is disposed in this recess between the end of the motor and the wall of the housing body.

In the present instance, the speed reducing transmission 34 is a gear train and its input is a worm 68 fast on the shaft 69 of the motor 33 and journaled in a bearing 70 which is seated in opposed recesses 71 and 72 (FIG. 5) in the housing body 13 and the partition skirt 61 respectively. The worm meshes with a worm gear 73 (FIGS. 4 and 6) formed with a central hub 74 which receives a splined section 75 of a shaft 76, the latter being parallel to the axis a. The hub projects down into a well 77 formed in the bottom of the body 13 and containing a lubricant. The lower end of the shaft 76 is journaled in a bearing 78 seated in the bottom wall of the housing body and an enlarged portion 79 of the shaft above the worm gear is journaled in a bearing sleeve 80 which is fitted in a cylindrical collar 81 formed in the top of the partition 60. The latter together with the sleeve 80 and the shaft portion 79 closes the well 77 and retains the lubricant in place. At its upper end, the shaft 76 is formed with a pinion 82 which meshes with a spur gear 83 centered on the axis a. The spur gear encircles and is journaled on the upper end portion of the coupler 37 and the spur gear abuts the flange 41 of the bearing 38 so that the hub 12 and the coupler may turn relative to the gear.

Clutch means is provided to selectively couple and uncouple the hub 12 and the spur gear 83, which constitutes the output of the gear train 34, so that the output shaft 19 of the operator may be driven either by the motor 33 through the gear train or manually by the crank arm 32 while bypassing the gear train. Such coupling and uncoupling preferably is achieved automatically as an incident to swinging the crank arm into and out of its inactive position and, for this purpose herein, the pin 49 on the crank arm constitutes a part of the clutch means. Thus, this pin is made long enough to project beyond the lower end of the slot 50 in the hub 12 and into a hole 84 (FIGS. 6 and 7) in the spur gear 83. Preferably, there are four such holes angularly spaced equally around the axis a. In the present instance, each hole is triangular with its base wall 85 nearest the axis and the side walls 86 and 87 inclined toward each other. As a result, one or the other of the side walls acts as an abutment engaging the pin 49 to drive the hub 12 and, at the same time, the wall tends to cam the pin radially inwardly and thereby hold the crank arm 32 in the inactive position. For example, when the gear 83 is being turned clockwise as indicated by the arrows in FIG. 7 to open the sash 10, the side wall 86 engages the pin and, due to this wall being inclined relative to a radius of the gear, the wall exerts an inward force on the pin as it drives the latter.

With the foregoing arrangement, the motor 33 is operable when energized to open or close the sash if the crank arm 32 is in its inactive position. Thus, the motor drives the gear train 34 which, through the pin 49, turns the hub 12 and this results in the coupler 37 and the shaft 19 being turned. Through the bevel gears 18 and 20, the shaft 19 turns the shaft 21 and, by virtue of the worm 28 and the worm gear sectors 26 and 27, the arms 22 and 23 are turned to swing the sash 10. When the crank arm is swung to its active position, however, the pin 49 is disengaged from the gear 83 and the crank arm may easily turn the cap to swing the sash without turning either the gears of the train 34 and/or the shaft 69 of the motor.

The invention also contemplates the provision of means for automatically stopping the motor 33 when the sash 10 has been opened a preselected amount and, herein, this means includes a counter 88 (FIGS. 5 and 7) responsive to the operation of the motor. Because of the speed of the latter, however, it is preferred to arrange the counter to be actuated directly by the output of the gear train 34 and operable to control the motor. In the illustrated form of the invention, the counter is a star wheel coacting with a pin 89 which is carried by the spur gear 83 and which engages the star wheel once during each revolution of the spur gear. The star wheel is formed on the upper end portion of a cylinder 90 which is journaled on stationary pin 91 to turn about an axis parallel to the axis a. The lower end portion of the pin 91 is anchored in the housing body 13 and is reduced in diameter to provide a shoulder 92 (FIG. 5) which abuts a boss 93 on the housing body. The upper end of the pin is upset to form a head 94 so that the cylinder 90 is captivated between the head and the boss 93 but is free to turn on the pin.

Figure 7:
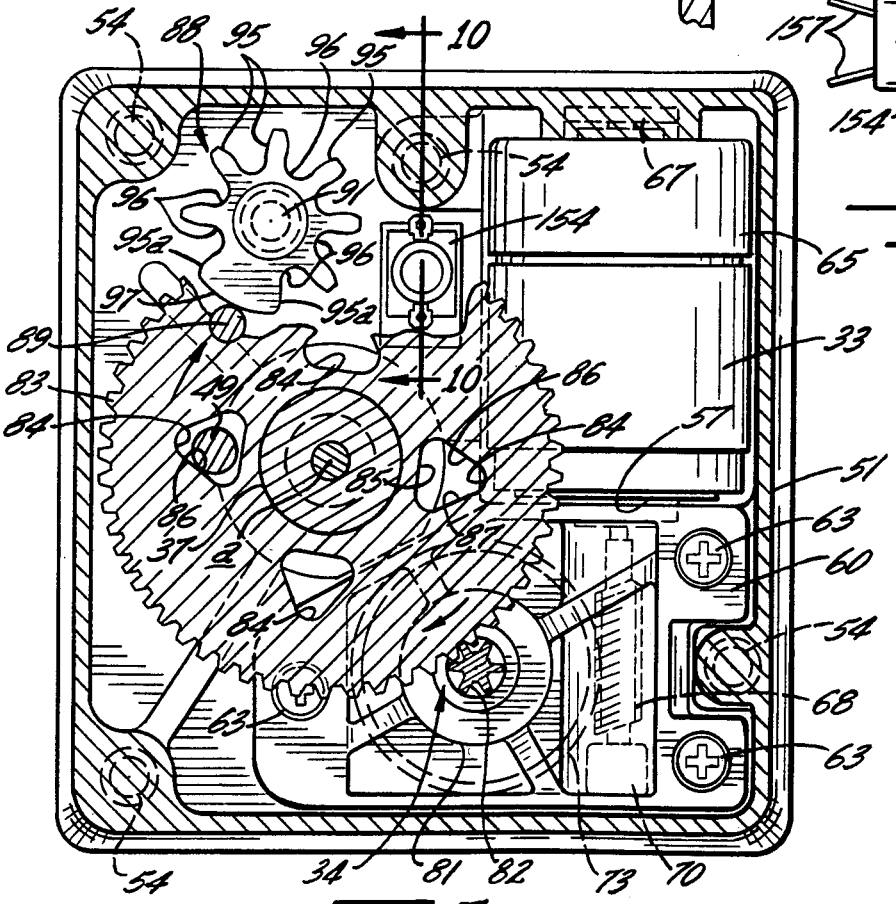
FIG. 7 is a sectional view taken along the line 7—7 in FIG. 6 but showing the parts in the moved position.
Figure 8:
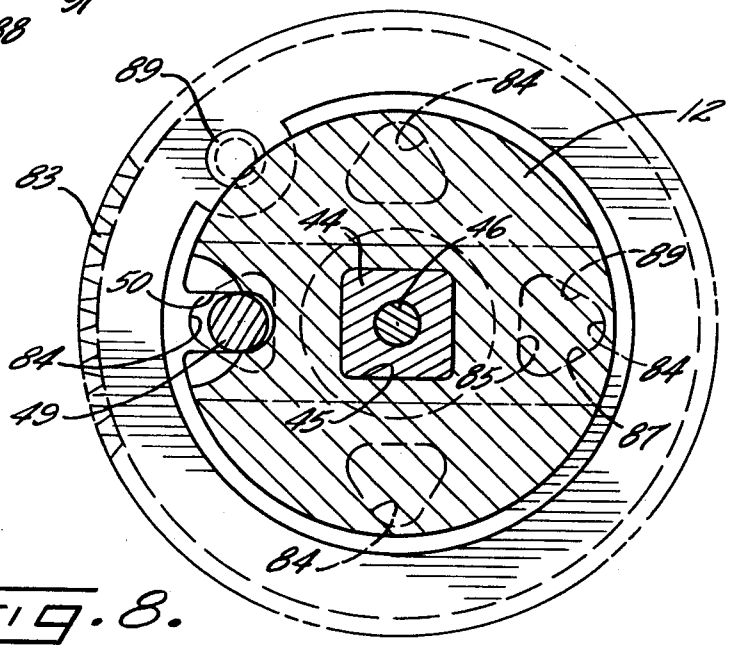
FIG. 8 is an enlarged sectional view taken along the line 8—8 in FIG. 6.

The actuating pin 89 for the star wheel 88 is staked to the spur gear 83 at a point spaced radially outwardly from the axis a and the pin is parallel to this axis and projects downwardly from the spur gear to be even with the star wheel as shown in FIG. 5. The star wheel has six equally spaced teeth 95 (FIGS. 4 and 7) and two partial teeth 95*a* to define seven pockets 96 and the wheel is filled between the partial teeth to form a peripheral land 97. Thus, as the spur gear is turned clockwise to open the sash 10, the pin 89 enters one of the pockets and turns the star wheel counterclockwise through one-eighth of a revolution, that is, 45 degrees. On succeeding revolutions of the spur gear, the actuating pin enters successive pockets until the land 97 has been brought into the path of the pin so that, on the next revolution of the spur gear, the pin abuts the land as shown in FIG. 7. Because the pin at that time is exerting a generally radial force on the star wheel, the latter is not turned and the motor 33 is in a stalling condition. As explained later in detail, the stall current of the motor is sensed to stop the motor so that the star wheel, in effect, constitutes both a revolution counter and a positive stop. Preferably the motor then is pulsed briefly in the reverse direction to relieve the torque in the motor shaft 69 and in the gear train 34.

When it is desired to close the sash 10, the motor 33 is run in the opposite direction to turn the spur gear 83 counterclockwise. As a result, the pin 89 backs away from the land 97 and, after almost a full revolution of the spur gear, it enters the pocket 96 just to the right of the land as viewed in FIG. 7. This causes the star wheel 88 to turn clockwise and it reaches its starting position as the sash abuts the window frame. Again, this produces a stall condition of the motor which thereby is stopped and reversed to relieve the torque in the actuator. In addition, a stall condition and stopping of the motor will occur at any time the sash abuts an obstruction such as when the sash abuts a hand between it and the window frame.

The control circuit for the motor 33 may be divided and contained partially in a control panel 98 (FIG. 11) and partially in a circuit box 99 with the leads 100 and 101 (FIGS. 4 and 6) from the circuit to the motor being part of an insulated cable 102 which projects into the housing 14 through a rubber plug 103 pressed into the bottom wall of the housing body 13. The motor and the control circuit utilize conventional 120 volt household alternating current through a service plug 104, a transformer 105 and a rectifier 106 to produce a 12 volt direct current for the motor and the circuit. When the motor is in a standby condition, that is, when it is not driving in either the opening or closing direction, both of its terminals 107 and 108 are positive. Thus, the terminal 107 is connected to the positive side of the rectifier through a line 109, a diode 110, a line 111, a movable contact 112 of the relay 113 and the lead line 100 while the terminal 108 similarly is connected through the line 109, the diode 110, the line 111, a movable contact 114 of another relay 115 and the lead line 101, the contacts 112 and 114 being effective to complete these circuits when their respective relays are deenergized. These contacts determine the direction in which the motor turns and, to this end, the contact 112 in its other position connects the terminal 107 through ground to the negative side of the rectifier and the contact 114 in its other position connects the terminal 108 to the negative side. When the terminal 107 is negative and the terminal 108 is positive, the motor turns in the direction to open the sash while the motor turns in the closing direction when the polarity of the terminals is reversed.

The movable contacts 112 and 114 are selectively controlled manually by push-button switches 116 and 117 respectively, these switches being on the control panel 98 and identified respectively as OPEN and CLOSE. A third push-button switch 118 identified as STOP also is mounted on the control panel. Each of these three push-button switches is normally held open by a spring and is closed momentarily to effect its function in the control circuit and each is connected to the positive side of the rectifier 106 by lines 119 and 120. The push-button switch 116 is effective to energize the coil 121 of the relay 113 and thereby move the contact 112 to its ground position for operation of the motor 33 in the opening direction. To this end, this push-button switch completes the circuit of the coil through the line 122 and a resistor 123 and through ground to the negative side of the rectifier. The relay 113 also includes a movable contact 124 which completes a holding circuit for the coil 121 through the line 119, lines 125 and 126, the contact 124 and lines 127, 128 and 129 to keep the motor 33 energized even though the push-button switch 116 is released. In a similar manner, the push-button switch 117 energizes the coil 130 of the relay 115 through a line 131, a resistor 132 and ground and this moves the contact 114 to the position in which the motor runs in the closing direction. A holding circuit for the coil 130 also is completed through the lines 119, 125 and 126, a movable contact 133 of the relay, and lines 134, 135 and 136. In the line 125, which is in the holding circuits of both relays, is the movable contact 137 of a relay 138 whose coil 139 is energized by the STOP push-button switch 118 through a line 140 so that, when the STOP switch is closed, the contact opens the circuit of whichever relay may be energized at the time. This deenergizes the motor and both of the terminals 107 and 108 return to their standby or positive condition.

In order to stop the motor 33 in response to its stall current when either the sash 10 or the counter pin 89 encounters a stop or an obstruction, a thermal breaker 141 is disposed in the line 119 in series with the contact 137. The thermal breaker is responsive to the current of the motor and opens when the current increases to the stall magnitude, this opening the holding circuit of whichever of the relays 113 and 115 is energized. Opening of the thermal breaker also is effective to pulse the motor in the opposite direction from which it had been turning to unwind the gear train 34 and, for this purpose, a movable contact 142 of the relay 113 may momentarily complete a circuit for the coil 130 of the other relay 115 while, conversely, a movable contact 143 of the relay 115 may momentarily complete a circuit for the coil 121 of the relay 113. The contact 142 completes the circuit for the coil 130 through a line 144 and the contact 143 completes the circuit for the coil 121 through a line 145.

Current for the momentary circuit of the coil 130 of the closing relay 115 is supplied by the discharge of a capacitor 146 which is in parallel with the coil 121 of the opening relay 113. When the latter is energized, the contact 142 is in the open position but, because the contact 124 of the holding circuit is in the closed position, the capacitor 146 is charged through a resistor 147 and a diode 148. When the thermal breaker 141 opens, the relay 113 drops out so that the contact 142 returns to its closed position and the capacitor 146 discharges through a diode 149, the contact 142 and the line 144 to momentarily energize the relay 115 and pulse the motor in the closing direction. Associated in a similar manner with the relay 115 is a capacitor 150 which is charged through a resistor 151 and a diode 152 and which discharges through a diode 153, the movable contact 143 of the relay 115 and the line 145 to momentarily energize the coil 121 of the relay 113 and pulse the motor in the opening direction. In the preferred embodiment, each capacitor discharges for about 0.1 second and this produces approximately fifty revolutions of the motor or from three to five degrees of turning at the bevel gear 18. After it has stopped the motor, the thermal breaker 141 resets itself so that the control circuit is again in a standby condition.

With the foregoing arrangement, the actuator may be set to open the sash 10 any preselected amount within the limits of the seven turns of the star wheel 88. To do this, the crank arm 32 is swung to its active position and used to turn the hub 12 and crank the sash out manually to the desired open position. Then, with the crank arm still in its active position, the OPEN switch 116 is depressed to energize the motor 33 in the opening direction. As a result, the gear train 34 including the output gear 83 is driven but the output shaft 19 of the operator is not turned because the hub 12 is not coupled to the output gear by the pin 49. Through the pin 89, however, the output gear turns the star wheel until this pin abuts the land 97 at which time the motor is stopped and reversed to unwind the gear train. As a result, the condition of the motor 33, the pin 89 and the star wheel 88 match the open condition of the sash. To complete the setting of the operator, it is necessary only to turn the hub 12 slightly until the pin 49 drops into the nearest one of the holes 84 in the output gear. Preferably, however, the hub 12 is turned back about one-half revolution before dropping the pin 49 in a hole 84 to back off of any internal stops which might be incorporated in the window assembly and this greatly increases the useful life of the operator and particularly of the shafts 19 and 21, the bevel gears 18 and 20, the worm 28 and worm gear sectors 26 and 27, and the linkage 17.

Figure 10:
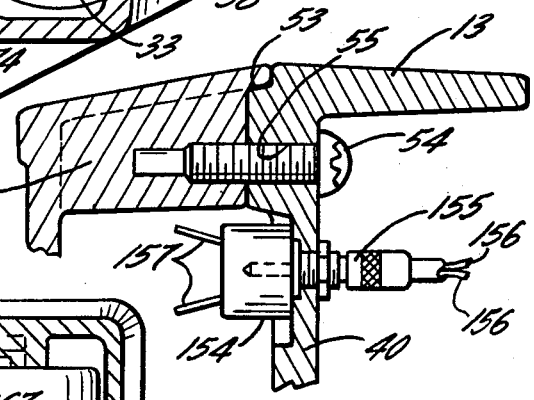
FIG. 10 is a fragmentary perspective view taken along the line 10—10 in FIG. 7.
Figure 11:
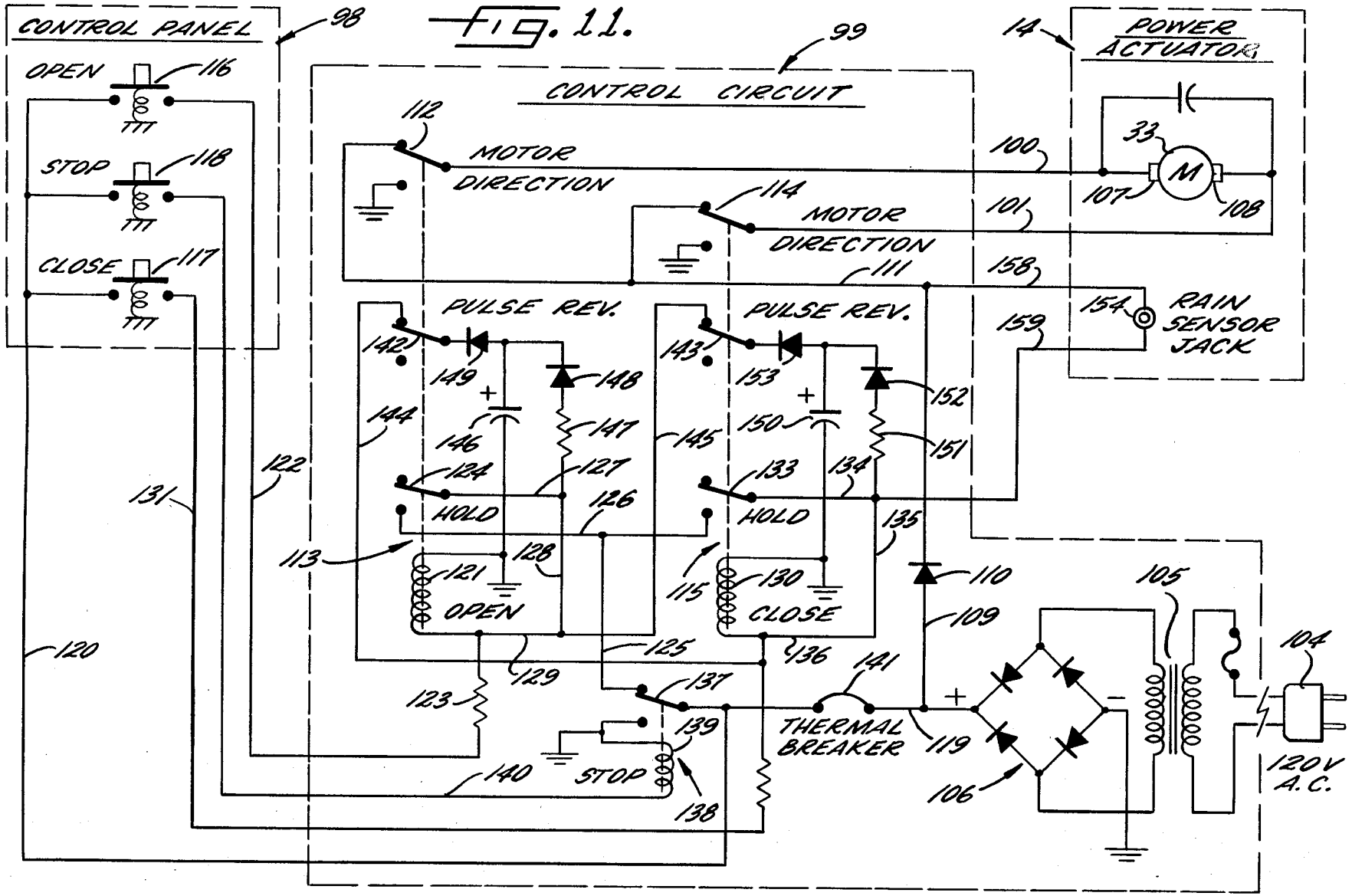
FIG. 11 is a schematic diagram of the circuit for the operator.

Advantage may be taken of the presence of the motor 33 and its control to open or close the sash 10 automatically in response to a condition such as temperature, rain, time and the like. For this purpose, a jack 154 (FIGS. 7 and 10) projects through and is clamped to the bottom wall of the housing body 13 and receives a plug 155 with leads 156 extending to a sensor (not shown). On the inside of the housing, the plug is provided with conventional terminals 157 to which leads 158 and 159 (FIG. 4) to the control circuit for the motor are attached, these leads being a part of the cable 102. In FIG. 11, the sensor is indicated as being a rain detector which is effective to close the sash and the sensor includes contacts (not shown) which, through the leads 158 and 159, are in a line parallel with the CLOSE push-button switch 117. Thus, rain water bridges the contacts of the sensor and completes this parallel circuit for the closing relay 115 and thereupon the elements of the control circuit function in the same manner as if the push-button switch 117 had been closed.

It will be observed that, with an operator as described above, a closure such as the sash 10 may be opened and closed by the motor 33 acting through the gear train 34 and, at the same time, the gear train may be disengaged to permit the sash to be operated manually through the use of the crank arm 32. Moreover, the pin 49 on the crank arm automatically couples and uncouples the gear train and the output shaft 83 of the gear train as an incident to the crank arm being swung to its inactive and active positions. The use of the star wheel 88 as a counter permits a selective adjustment as to the open position of the sash and, by using the stall current of the motor to stop the motor in either of the limit positions of the sash, the motor also stops if the sash encounters an obstruction, thus providing a safety feature in the operator. By using the land 97 on the star wheel to stall the motor at the open position of the shaft, the internal stops of the operator are not used and this materially increases the life of the operator. By pulsing the motor in the reverse direction after opening or closing the sash, the gear train is unwound relieving the torsion in the drive and further improving the life of the operator.

I claim:

1. A power actuated operator for a movable closure, said operator having, in combination, a housing, a driven member mounted on said housing and adapted to be coupled to the closure, a rotatable drive member journaled in said housing and connected to said driven member whereby turning said drive member operates said driven member and moves said closure, a motor disposed within said housing, a speed reducing transmission disposed within said housing and having an input member driven by said motor and an output member, clutch means selectively operable to couple and uncouple said drive member and said output member whereby said motor drives said driven member through said transmission and said drive member when said output member is coupled to the drive member, and a manual member operatively connected to said drive member to turn the latter and drive said driven member independently of said motor and said transmission when the drive member is uncoupled from the output member.

2. A power actuated operator as defined in claim 1 in which said manual member is movable between an inactive position and an active position and said clutch means couples and uncouples said drive member and said output member automatically as an incident to the manual member moving into said inactive position and said active position respectively.

3. A power actuated operator for a movable closure, said operator having, in combination, a housing, an output shaft journaled in said housing and adapted to be coupled to the closure, a rotatable drive member journaled in said housing coaxially with said output shaft and connected to the latter whereby turning said member turns the shaft and moves said closure, a motor disposed within the housing, a speed reduction gear train having an input gear driven by said motor and an output gear coaxial with said output shaft and rotatable independently of said drive member, said drive member having an outer end portion remote from said output shaft projecting through said housing, a crank arm pivotally mounted on the outer end portion of said drive member at a point offset from the axis of the latter, said crank arm being swingable between an active position projecting radially outwardly from said drive member and an inactive position overlying the drive member, a pin projecting transversely from said crank arm to be gripped manually to turn said drive member thereby to turn said output shaft independently of said motor, and an abutment on said output gear engaging said pin when said crank arm is in said inactive position whereby said motor drives said output shaft through said gear train and said drive member.

4. A power actuated operator as defined in claim 3 in which said output gear has a hole receiving said pin and said abutment is a wall of said hole.

5. A power actuated operator as defined in claim 4 in which said motor is reversible thereby selectively to drive said output gear in clockwise and counterclockwise directions and said pin engages the wall of said hole to turn said drive member in each of such directions.

6. A power actuated operator as defined in claim 4 in which a pluarlity of such holes are formed in said output gear and said holes are angularly spaced around the output gear whereby each may receive said pin.

7. A power actuated operator for a movable closure, said operator having, in combination, a housing, an output shaft journaled in said housing and adapted to be coupled to the closure, a rotatable drive member journaled in said housing coaxially with said output shaft and connected to the latter whereby turning said member turns the shaft and moves said closure, a reversible motor disposed within the housing, a speed reduction gear train having an input gear driven by said motor and an output gear coaxial with said output shaft and rotatable independently of said drive member, said drive member having an outer end portion remote from said output shaft projecting through said housing, a crank arm pivotally mounted on the outer end portion of said drive member at a point offset from the axis of the latter, said crank arm being swingable between an active position projecting radially outwardly from said drive member and an inactive position overlying the drive member, a pin projecting transversely from said crank arm to be gripped manually to turn said drive member thereby to turn said output shaft independently of said motor, and a hole in said output gear receiving said pin when said crank arm is in said inactive position, said hole having first and second oppositely facing walls each engaged by said pin in one direction of drive of said motor whereby the motor drives said output shaft through said gear train and said drive member.

8. A power actuated operator as defined in claim 7 in which said walls of said hole are inclined relative to each other and relative to a radius of said output gear and converge toward the periphery of the latter whereby each wall when it engages said pin urges the pin radially inwardly and tends to hold said crank arm in said inactive position.

9. A power actuated operator as defined in claim 8 in which a plurality of such holes are formed in said output gear and said holes are angularly spaced around the output gear whereby each may receive said pin.

10. A power actuated operator for a movable closure, said operator having, in combination, a housing, a driven member mounted on said housing and adapted to be coupled to the closure, a rotatable drive member journaled in said housing and connected to said driven member whereby turning said drive member operates said driven member and moves the closure, an electric motor disposed within said housing, a speed reducing transmission disposed within said housing and having an input member driven by said motor and an output member, means operable to couple said drive member and said output member whereby said motor when energized drives said driven member through said transmission and said drive member, limit means operable in response to preselected movement of the closure to prevent said motor from turning of said drive member and stall the motor, and control means responsive to stalling of said motor to deenergize the same.

11. A power actuated operator as defined in claim 10 in which said limit means is a counter responsive to the revolutions of said motor.

12. A power actuated operator as defined in claim 10 in which said motor is reversible and said control means is operable after the motor has been deenergized to momentarily energize the motor in the reverse direction thereby to relieve torque in said transmission.

13. A power actuated operator as defined in claim 10 in which said motor is reversible and said control means includes a sensor responsive to a condition and operable to cause the motor to turn in the reverse direction in response to the presence of the condition.

14. A power actuated operator for a movable closure, said operator having, in combination, a housing, a driven member mounted on said housing and adapted to be coupled to the closure, a rotatable drive member journaled in said housing and connected to said driven member whereby turning said drive member operates said driven member and moves said closure, an electric motor disposed within said housing, a speed reducing transmission disposed within said housing and having an input member driven by said motor and an output member, clutch means selectively operable to couple and uncouple said drive member and said output member whereby said motor when energized drives said driven member through said transmission and said drive member when said output member is coupled to the drive member, a manual member operatively connected to said drive member to turn the latter and drive said driven member independently of said motor and said transmission when the drive member is uncoupled from the output member, a counter driven by said motor and operable in response to preselected movement of said closure to prevent said motor from turning said drive member and stall the motor, and control means responsive to stalling of said motor to deenergize the same.

15. A power actuated operator as defined in claim 14 in which said motor is reversible and said control means is operable after the motor has been deenergized to momentarily energize the motor in the reverse direction thereby to relieve torque in said transmission.

16. A power actuated operator as defined in claim 15 in which said control means includes a sensor responsive to a condition and the sensor is operable to cause the motor to turn in the reverse direction in response to the presence of the condition.

17. A power actuated operator for a movable closure, said operator having, in combination, a housing, an output shaft journaled in said housing and adapted to be coupled to the closure, a rotatable drive member journaled in said housing coaxially with said output shaft and connected to the latter whereby turning said member turns the shaft and moves said closure, an electric motor disposed within the housing, a speed reduction gear train having an input gear driven by said motor and an output gear coaxial with said output shaft and rotatable independently of said drive member, said drive member having an outer end portion remote from said output shaft projecting through said housing, a crank arm pivotally mounted on the outer end portion of said drive member at a point offset from the axis of the latter, said crank arm being swingable between an active position projecting radially outwardly from said drive member and an inactive position overlying the drive member, a pin projecting transversely from said crank arm to be gripped manually to turn said drive member thereby to turn said output shaft independently of said motor, an abutment on said output gear engaging said pin when said crank arm is in said inactive position whereby said motor when energized drives said output shaft through said gear train and said drive member, a star wheel rotatably mounted in said housing adjacent said output gear to turn about an axis parallel to the axis of the gear, a second pin mounted on said output gear and engaging said star wheel during each revolution of the output gear to index the start wheel through a predetermined angle, an abutment on said star wheel engageable with said second pin after the star wheel has been indexed a selected number of times and operable to prevent said output gear from turning thereby to stall said motor, and control means responsive to stalling of said motor to deenergize the same.

18. A power actuated operator as defined in claim 17 in which said motor is reversible and said control means is operable after the motor has been deenergized to momentarily energize the motor in the reverse direction thereby to relieve torque in said gear train.

* * * * *